US006777862B2

(12) United States Patent
Fisch et al.

(10) Patent No.: US 6,777,862 B2
(45) Date of Patent: Aug. 17, 2004

(54) SEGMENTED ELECTRODE HALL THRUSTER WITH REDUCED PLUME

(75) Inventors: Nathaniel J. Fisch, Princeton, NJ (US); Yevgeny Raitses, Princeton, NJ (US)

(73) Assignee: General Plasma Technologies LLC, Princeton, NJ (US)

( * ) Notice: Subject to any disclaimer, the term of this patent is extended or adjusted under 35 U.S.C. 154(b) by 0 days.

(21) Appl. No.: 09/834,373

(22) Filed: Apr. 13, 2001

(65) Prior Publication Data

US 2002/0008455 A1 Jan. 24, 2002

Related U.S. Application Data

(60) Provisional application No. 60/197,280, filed on Apr. 14, 2000.

(51) Int. Cl.[7] ..... H05H 1/00

(52) U.S. Cl. ..... 313/359.1; 313/361.1; 313/362.1; 313/363.1; 315/501

(58) Field of Search ..... 313/359.1, 361.1, 313/362.1, 363.1, 501

(56) References Cited

U.S. PATENT DOCUMENTS 5,475,354 A * 12/1995 Valentian et al. ..... 335/296
5,751,113 A * 5/1998 Yashnov et al. ..... 315/111.21
5,845,880 A * 12/1998 Petrosov et al. ..... 244/169
5,973,447 A * 10/1999 Mahoney et al. ..... 313/359.1
6,448,721 B2 * 9/2002 Raitses et al. ..... 315/501

* cited by examiner

*Primary Examiner*—Ashok Patel
*Assistant Examiner*—Kevin Quarterman

(57) ABSTRACT

An apparatus and method for thrusting plasma, utilizing a Hall thruster with segmented electrodes along the channel, which make the acceleration region as localized as possible. Also disclosed are methods of arranging the electrodes so as to minimize erosion and arcing. Also disclosed are methods of arranging the electrodes so as to produce a substantial reduction in plume divergence. The use of electrodes made of emissive material will reduce the radial potential drop within the channel, further decreasing the plume divergence. Also disclosed is a method of arranging and powering these electrodes so as to provide variable mode operation.

20 Claims, 4 Drawing Sheets

SEGMENTED ELECTRODE HALL THRUSTER WITH REDUCED PLUME

CROSS REFERENCE TO RELATED APPLICATIONS

This application claims priority from U.S. Provisional Application Serial No. 60/197,280 filed Apr. 14, 2000, by applicants Nathaniel J. Fisch and Yevgeny Raitses, the disclosure of which is incorporated herein by reference.

CONTRACTUAL ORIGIN OF THE INVENTION AND STATEMENT AS TO FEDERALLY SPONSORED RESEARCH

Pursuant to 35 U.S.C. 202(c), it is acknowledged that the U.S. Government has certain rights in the invention described herein which was made in part with funds from the Department of Energy under Grant No. DE-AC02-76-CHO-3073 under contract between the U.S. Department of Energy and Princeton University. Princeton University has served notice that it does not wish to retain title to this invention.

BACKGROUND OF THE INVENTION

The present invention pertains generally to electric plasma thrusters and more particularly to Hall field thrusters, which are sometimes called Hall accelerators.

The Hall plasma accelerator is an electrical discharge device in which a plasma jet is accelerated by a combined operation of axial electric and magnetic fields applied in a coaxial channel. The conventional Hall thruster overcomes the current limitation inherent in ion diodes by using neutralized plasma, while at the same time employing radial magnetic fields strong enough to inhibit the electron flow, but not the ion flow. Thus, the space charge limitation is overcome, but the electron current does draw power. Hall thrusters are about 50% efficient. Hall accelerators do provide high jet velocities, in the range of 10 km/s to 20 km/s, with larger current densities, about 0.1 A/cm$^2$, than can conventional ion sources.

Hall plasma thrusters for satellite station keeping were developed, studied and evaluated extensively for xenon gas propellant and jet velocities in the range of about 15 km/s, which requires a discharge voltage of about 300 V. Hall thrusters have been developed for input power levels in the general range of 0.5 kW to 10 kW. While all Hall thrusters retain the same basic design, the specific details of an optimized design of Hall accelerators vary with the nominal operating parameters, such as the working gas, the gas flow rate and the discharge voltage. The design parameters subject to variation include the channel geometry, the material, and the magnetic field distribution.

A. V. Zharinov and Yu. S. Popov, "Acceleration of plasma by a closed Hall current", Sov. Phys. Tech. Phys. 12, 1967, pp. 208–211 describe ideas on ion acceleration in crossed electric and magnetic field, which date back to the 1950's. The first publications on Hall thrusters appeared in the United States in the 1960's, such as: G. R. Seikel and F. Reshotko, "Hall Current Ion Accelerator", Bulletin of the American Physical Society, II (7) (1962) and C. O. Brown and E. A. Pinsley, "Further Experimental Investigations of Cesium Hall-Current Accelerator", AIAA Journal, V.3, No 5, pp. 853–859, 1965.

Over the last thirty years, A. I. Morozov designed a series of high-efficiency Hall thrusters. See, for example, A. I. Morozov et al., "Effect of the Magnetic field on a Closed-Electron-Drift Accelerator", Sov. Phys. Tech. Phys. 17(3), pp. 482–487 (1972), A. I. Morosov, "Physical Principles of Cosmic Jet Propulsion", Atomizdat, Vol. 1, Moscow 1978, pp. 13–15, and A. I. Morozov and S. V. Lebedev, "Plasma Optics", in Reviews of Plasma Physics, Ed. by M. A. Leontovich, V.8, New York-London (1980).

H. R. Kaufman, "Technology of Closed Drift Thrusters", AIAA Journal Vol. 23 p. 71 (1983), reviews of the technology of Hall field thrusters, both in the context of other closed electron drift thrusters and in the context of other means of thrusting plasma. V. V. Zhurin et al., "Physics of Closed Drift Thrusters", Plasma Sources Science Technology Vol. 8, p. R1 (1999), further reviews the physics and more recent developments in the technology of Hall thrusters.

What remains a challenge is to develop a Hall thruster able to operate efficiently with minimal plume divergence. What is a further challenge is to accomplish such operation with the same thruster in several parameter regimes, such as at different input powers or at varying output thrusts. A number of issues arise with such variable operation of Hall current accelerators. These issues include decreased thruster efficiency for low mass flow rate and for low discharge voltages. At lower mass flow rates, lower atomic density in the channel results in an increased ionization mean free path of propellant atoms. A longer ionization length reduces the ionization efficiency and increases ion losses in the channel. Moreover, an extended ionization region produces a spread of ion energies, including slow ions. These slow ions are particularly vulnerable to radial accelerations and so contribute importantly to the plume divergence. This is a crucial issue even for non-variable operation. A similar effect would be incurred through the use of not easily ionized gases.

The present invention comprises an improvement over the prior art cited above by providing for efficient operation, with decreased plume divergence, and with capability for variable operation. The present invention discloses means of accomplishing these objectives through the placement of segmented electrodes along the inner and outer channel walls with the electrode segments held at specific potentials that lead to the improved operation.

The present invention comprises an improvement as well as over the following prior art:

U.S. Pat. No. 4,862,032 ("End-Hall ion source", Kaufman et al., Aug. 29, 1989) discloses specifically that the magnetic field strength decreases in the direction from the anode to the cathode. The disclosure of the above referenced patent is hereby incorporated by reference.

Other design suggestions are disclosed in U.S. Pat. No. 5,218,271 ("Plasma accelerator with closed electron drift", V. V. Egorov et al., Jun. 8, 1993) which contemplates a curved outlet passage. The disclosure of the above referenced patent is hereby incorporated by reference. U.S. Pat. No. 5,359,258 ("Plasma accelerator with closed electron drift", Arkhipov et al., Oct. 25, 1994) contemplates improvements in magnetic source design by adding internal and external magnetic screens made of magnetic permeable material between the discharge chamber and the internal and external sources of magnetic field. The disclosure of the above referenced patent is hereby incorporated by reference.

U.S. Pat. No. 5,475,354 ("Plasma accelerator of short length with closed electron drift", Valentian et al., Dec. 12, 1995) contemplates a multiplicity of magnetic sources producing a region of concave magnetic field near the acceleration zone in order better to focus the ions. The disclosure of the above referenced patent is hereby incorporated by reference. U.S. Pat. No. 5,581,155 ("Plasma accelerator with closed electron drift", Morozov, et al., Dec. 3, 1996) similarly contemplates specific design optimizations of the conventional Hall thruster design, through specific design of the magnetic field and through the introduction of a buffer chamber. The disclosure of the above referenced patent is hereby incorporated by reference.

U.S. Pat. No. 5,763,989 ("Closed drift ion source with improved magnetic field", H. R. Kaufman Jun. 9, 1998) contemplates the use of a magnetically permeable insert in the closed drift region together with an effectively single source of magnetic field to facilitate the generation of a well-defined and localized magnetic field, while, at the same time, permitting the placement of that magnetic field source at a location well removed from the hot discharge region. The disclosure of the above referenced patent is hereby incorporated by reference. U.S. Pat. No. 6,075,321 ("Hall field plasma accelerator with an inner and outer anode", V. J. Hruby, Jun. 13, 2000) contemplates an anode that can be part of either the inner or outer walls, rather than simply part of an inlet wall, but not a series of segmented electrodes for detailed control of the axial potential. The disclosure of the above referenced patent is hereby incorporated by reference.

U.S. Pat. No. 5,847,493 ("Hall effect plasma accelerator", Yashnov et al., Dec. 8, 1998) proposes that the magnetic poles in an otherwise conventional Hall thruster be defined on bodies of material which are magnetically separate. The disclosure of the above referenced patent is hereby incorporated by reference.

U.S. Pat. No. 5,845,880 ("Hall effect plasma thruster", Petrosov et al., Dec. 8, 1998) proposes a channel preferably flared outwardly at its open end so as to avoid erosion. The disclosure of the above referenced patent is hereby incorporated by reference.

The closest configuration in the literature to the present invention appears to be Russian Patent SU 1796777 A1 (Yu. M. Lisikov, V. V. Gopanchuk and I. B. Sorokin, "Stationary Plasma Thruster", Applied Jun. 28, 1991, Issued: Feb. 23, 1993, Bulletin 7, in Russian). Lysikov et al. discloses an additional internal thermionic cathode, supplementary to the cathode compensator outside the acceleration region. The internal cathode is apparently placed where the magnetic field lines are approximately radial, which is approximately at the radial magnetic field maximum. The internal cathode is positioned on the discharge chamber apparently at the potential of the external cathode. In contrast to Lysikov et al., we disclose the design and use of emissive and non-emissive electrodes specifically configured so as to control and improve the voltage profile and thereby minimize the plume divergence. The disclosure of the above referenced patent is hereby incorporated by reference.

BRIEF SUMMARY OF THE INVENTION

It is an object of this invention to provide an improved Hall plasma thruster by means of detailed control of the electric field.

It is a further object of this invention to provide an improved plasma thruster, which provides better focusing of the ion trajectories, thereby providing a more directional plume. A more tightly focused plasma plume reduces channel erosion, improves thrust, and facilitates integration with other satellite components.

The invention exploits the fact that the lines of magnetic force form surfaces of substantially constant electric potential. Since the magnetic field lines intersect the thruster channel, the potential distribution within the channel can be determined by imposing a potential distribution on the channel, through the placement of electrodes on the channel wall. The potential drop can then be imposed in a predetermined region of the thruster channel.

In the operation of a conventional Hall thruster, the total accelerating voltage, namely the voltage drop between the cathode and the anode, is fixed. However, the specific profile of the voltage drop between the anode and the cathode is dependent upon the details of the plasma flow and the magnetic field distribution. In order to control the electric potential in detail and, in particular, independent of the magnetic field, electrode segments are inserted along the plasma channel.

If the electrodes are not emissive, then an electrostatic plasma sheath will form in the vicinity of the electrode so as to shield the thruster interior from the electrode potential. This will generally be a deleterious effect, if not carefully designed, as ions will fall through a radial potential and strike the wall to balance the electron flux to the wall. However, if emissive electrode segments are employed, cold electrons are emitted from the wall, balancing the current of hot electrons to the wall, so that a radial sheath potential will not form. The ions are then not exposed to a radial potential drop. The ions then tend not to strike the wall and will produce a more tightly focused plasma plume. We disclose herein certain configurations of emissive and non-emissive electrodes to optimize thruster performance particularly by focusing the plume.

SUMMARY OF INVENTION

The present invention discloses an apparatus and method for thrusting plasma, utilizing a Hall thruster with segmented electrodes along the channel, which make the acceleration region as localized as possible. Also disclosed are methods of arranging the electrodes along the plasma channel so as to increase efficiency and minimize erosion and arcing. Also disclosed are methods of arranging the electrodes so as to produce a substantial reduction in plume divergence. The use of electrodes made of emissive material will reduce the radial potential drop within the channel, further decreasing the plume divergence. Also disclosed is a method of arranging and powering these electrodes so as to provide variable mode operation.

Since the magnetic field lines in a Hall thruster comprise magnetic surfaces at substantially the same electric potential, the voltage in the thruster interior may be substantially defined by imposing a specified electric potential on an electrode on the periphery of said interior region, such that the magnetic field line that permeates said interior thruster region also intersects said electrode. The method of specifying the potential on this field line is by inserting an electrode within the thruster channel, held at said potential, and such that said field line intersects said electrode.

This idea can be understood with reference to FIG. 1. FIG. 1 is a schematic representation of the plasma channel with segmented electrodes. Line 1A—1A is a magnetic field line that extends from electrode segment 2 on channel wall 3 to an interior region in the thruster, which, which is approximately midway along the magnetic field line 1A—1A. The magnetic field line extends to channel wall 5. Similarly, Line 1B—1B is a magnetic field line that extends from electrode segment 4 on channel wall 3 to an interior region in the thruster, which is approximately midway along the magnetic field line 1B—1B, and then similarly intersects the opposite channel wall 5. In a Hall thruster, lines 1A—1A and 1B—1B would be substantially in the radial direction near the maximum of the magnetic field (see FIG. 2). For example, channel wall 3 could be the outer thruster wall and channel wall 5 could be the inner thruster wall, although the segmented electrodes could be placed against either or both walls so long as the same magnetic field lines is intersected by the electrode.

In the absence of plasma sheath effects, magnetic field line 1A—1A tends to be at the same electric potential, since electrons can move freely along the field line to cancel any potential differences. Moreover, in a Hall thruster, electrons drift in the azimuthal direction, so that all field lines that intersect the channel at the same axial position tend to form surfaces of the same electric potential. The plasma sheath potential arises in order to balance the electron current to the channel wall by an ion current to the wall. If the electron axial flow is impeded by the magnetic field, then energetic electrons strike the wall faster than the ions do, until a sheath potential develops. However, if the electron temperature is small, or if the wall surface emits electrons, the sheath potential will be correspondingly small. The sheath potential impedes electrons from entering wall, but accelerates ions towards the wall. Accordingly, the sheath potential is a cause for ion plume divergence in Hall thrusters.

In one embodiment of the invention, the plasma sheath potential is small. Then all points along magnetic field line 1A—1A are at approximately the same potential. Similarly, all points along magnetic field line 1B—1B are at approximately the same potential. The voltage source 6 establishes a potential drop between electrode segment 2 and electrode segment 4. Because each field line is substantially at the same potential along its own full length, said potential drop established between magnetic field line 1A—1A and magnetic field line 1B—1B persists along the full length of both lines even throughout the thruster interior.

In a second embodiment of the invention, the plasma sheath effect may not be small. In said second embodiment, said electron potential along said magnetic field line 1A—1A is determined partly by said potential imposed on electrode 2 and partly by electric sheath potential. However, by providing electrode 2 with emissive properties, said electrode 2 will emit electrons along magnetic field line 1A—1A in such a manner as to cancel electric sheath potential.

In yet a third embodiment of the invention, the plasma sheath may not be small, yet electrodes without substantial emissive properties are employed. However, the electrodes are placed so as to minimize the plume divergence by providing for substantial axial accelerating potential in a precise and favorable region of the thruster channel.

FIG. 2 is a schematic representation Hall thruster with segmented electrode rings 7*a* and 7*b* on the outer ceramic channel wall 25. Line 0—0 is an axis of symmetry. Segmented electrode 7*b* is near the thruster exit. Hollow cathode 8 emits electrons and neutralizes the flow of ions. An accelerating voltage drop is applied between anode 14 and hollow cathode 8, such that ions formed near the anode 14 are accelerated towards the thruster exit. The anode 14 can also be a as distributor. Magnetic field lines 10 extend from magnetic pole pieces 11 on the outer ceramic channel wall 25 and intersect magnetic pole pieces 12 on the inner ceramic channel wall 23. Electromagnetic coils 15 generate the magnetic field, which is guided through magnetic circuit 9 to the pole pieces. (An additional optional matched set of segmented electrodes 7*c* and 7*d*, placed on the inner channel wall 23 supplements said segmented electrode set 7*a* and 7*b*, such that said segmented electrode 7*c* intersects the same magnetic line of force as does electrode 7*a* and is held at the potential of electrode 7*a*. Similarly, said segmented electrode 7*d* intersects the same magnetic line of force as does electrode 7*b* and is held at the potential of electrode 7*b*.)

The electron current in the conventional Hall thruster provides the space charge neutralization and also assists in the ionization. While the current is primarily in the azimuthal direction, some axial current is necessary for the charge neutralization to occur. The electrons are normally introduced only through a cathode compensator, which could be a hollow cathode 8, outside of the main acceleration region of the ions and outside the region of intense magnetic fields. Thus, to neutralize the flow the electrons must travel axially towards the anode 14. Anode 14 can also serve as a gas distributor. Since power dissipated is proportional to current, the extent to which current is carried by these electrons is an unavoidable inefficiency. In addition to neutralizing the space charge within the acceleration region, the cathode compensator also serves to introduce electrons that neutralize the ion flow out of the thruster and eventually recombine with the ions. Thus the cathode compensator introduces electrons flowing in opposite axial directions: both electrons that flow back towards the anode and electrons that flow with the ion stream.

In a representative embodiment, the use of the set of segmented electrodes 7*a* and 7*b* is disclosed as an improvement. Rather than employing the cathode compensator outside the magnetic field for a dual purpose, we disclose how these functions may be separated. In the improved configuration, the cathode compensator outside the magnetic field need introduce only electrons that flow with the ions. The flow counter to the ions can be impeded by biasing the cathode 8 relative to segmented electrode 7*b* so that the ions experience a very small axial deceleration after leaving the acceleration region.

We disclose further that the set of segmented electrodes 7*a* and 7*b* provides a substantial voltage drop in a precise and predetermined location, thereby narrowing the ion plume and producing other advantages. We further disclose that said segmented electrodes 7*a* and 7*b* could be made of substantially emissive material not only to reduce deleterious effects of a plasma sheath but also to provide electrons necessary for ionization of the propellant gas. Each segment of an emissive electrode provides electrons by thermionic emission, secondary emission, field emission, capillary injection of electrons, or some other plasma producing means. The electrons so provided are available for charge neutralization, sheath reduction, or impact ionization of the neutral gas.

Note that the electrons need flow azimuthally only in the crossed electric and magnetic fields to provide the charge neutralization. Therefore, in yet another embodiment of the invention, a set of emissive segmented electrodes, such as set 7*a* and 7*b*, maintains the localized voltage drop at a precise and specified location within the acceleration region as well as providing for charge neutralization within the acceleration region. We disclose that the magnetic field that is imposed within the acceleration region may be allowed to be too large to permit electron axial current sufficient for ionization of the neutral gas. Instead, an additional emissive electrode segment, located between the acceleration region and the anode in a region of lower radial magnetic field, provides sufficient electrons for ionization of the neutral propellant gas. This additional electrode could be segmented electrode 7*a*, which is made sufficiently emissive not only to neutralize the electron sheath along the magnetic line of force intersecting it, but also to provide sufficient electrons for ionizing the upstream gas near the anode 14. In addition, a highly emissive segmented electrode 7*b* could provide sufficient electrons for neutralizing the accelerated ions, thus effectively serving also as the cathode-neutralizer 8.

Thus, it is a further object of the present invention to provide the electron current only where it is needed. The invention may thus be thought of also as a means of replacing some or all of the functions of the hollow cathode compensator 8. The consequence will be to reduce the electron power loss and thus improve the thruster efficiency of operation. Moreover, since the axial electron current is not essential in the acceleration region, higher magnetic fields can be used, without impeding the axial electron flow necessary for ionization. The use of high magnetic fields results in higher thrust density, since the thrust density cannot exceed the highest magnetic field energy density.

DETAILED DESCRIPTION OF THE INVENTION

Figure 1:
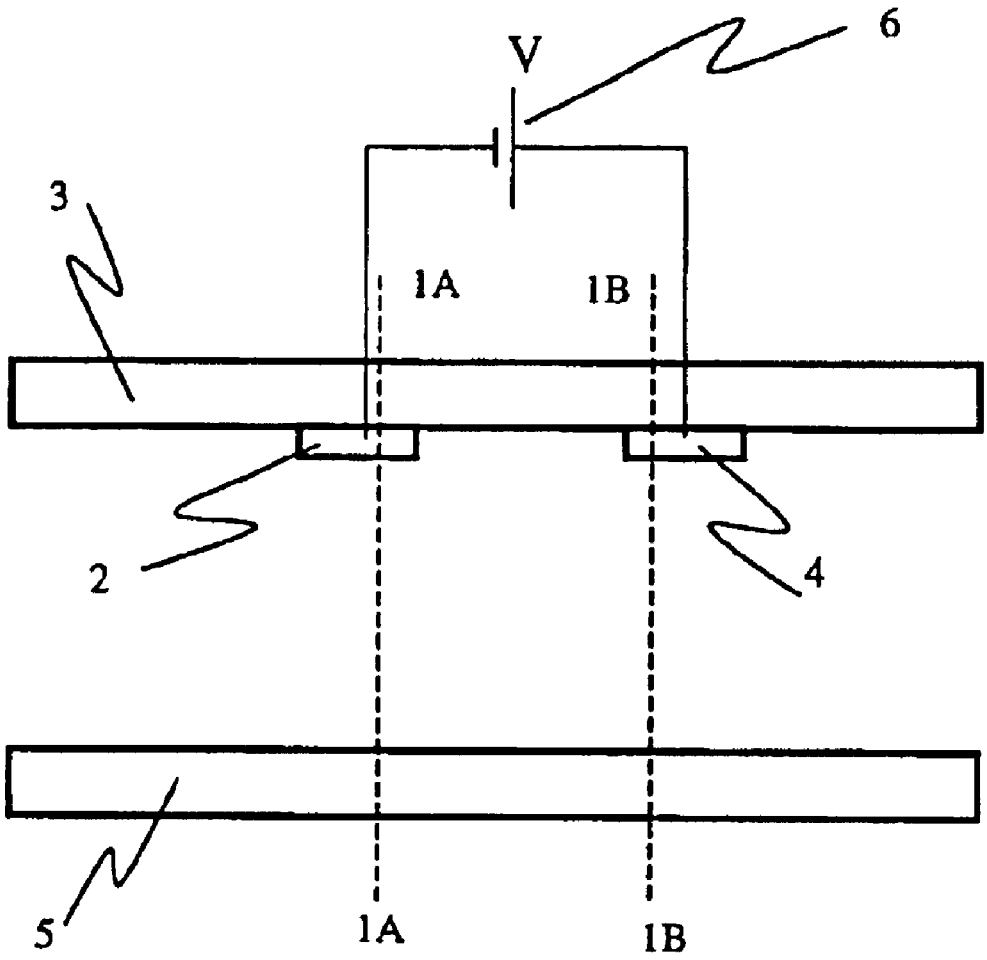
FIG. 1 is a schematic representation of how segmented electrodes inserted into the plasma channel can impose a predetermined and localized potential drop in the thruster interior. Line 1A—1A is a magnetic field line that extends from electrode segment 2 on channel inner wall 3 to an interior region in the thruster, and then to outer wall 5 of the thruster. Similarly, Line 1B—1B is a magnetic field line that extends from electrode segment 4 on inner channel wall 3 to an interior region in the thruster, and then to outer channel wall 5 of the thruster.

The invention results from the realization that a more efficient, high performance plasma accelerator with closed electron drift can be achieved by employing segmented electrodes along the plasma channel so as to produce localized potential drops in the plasma interior. It is further anticipated that emissive electrodes will reduce the sheath potential in the plasma channel. An additional benefit is that these electrodes may also collect low energy ions.

In one representative design, but in no way meant to limit variations on this design, the electrodes can be ring-shaped, and fit into grooves or otherwise attached in the outer wall or in the inner wall. These electrodes can be of different thickness and heights. These electrodes can also be combined from several thin rings and electrically isolated from each other. The electrode surface in contact with the plasma can be flat with the ceramic channel or extend above the channel. We disclose that we have found advantages to having the segmented electrode on the anode-side extend into the channel, particularly at low mass-flow rates, thereby reducing the channel cross sectional area in order to keep the ionization high. At high mass-flow rates, we disclose that there are advantages to keep the segmented electrode ring indented relative to the surface of the ceramic channel, thereby reducing the sputtering of the electrode.

The segmented electrodes can be connected to a bias power supply. Said bias power supply can be the main discharge power supply, a separate power supply, or a power supply though a separate electric circuit from the main discharge power supply with a different potential applied such a via a resistor. In the case of several segmented electrodes, each ring can be biased separately at different potentials, from the same or separate power supplies or separate electric circuits. We further disclose that operating segmented electrodes at the local floating potential, rather than at a bias potential, can also be advantageous. Dielectric insulators can separate the electrodes. The radial magnetic field provides magnetic insulation so that very abrupt potential drops, and a very localized acceleration region, can be established in the thruster channel. The localization can be in a region of concave magnetic field for maximum focusing, resulting in less plume divergence.

The electrodes can either be non-emissive or emissive. Non-emissive segmented electrodes can be made from a low sputtering material such as graphite or graphite modifications such as carbon-carbon fibers, tungsten, or molybdenum. Emissive segmented electrodes can be made from high-temperature low sputtering and low work function materials. Said materials include LaB6, dispenser tungsten, and barium oxide. To provide higher emissivity, additional external heating can be supplied from a heating filament inserted into the electrode structure. We disclose that if the filament heater is made from a wire, said wire could be twisted in order to limit any deleterious magnetic fields associated with the current flowing through the filament.

We disclose that the electrodes are configured so as to produce a potential drop over a narrow region, in particular over that region where the magnetic field lines are substantially in the radial direction. Pairs if electrodes, such as segmented electrode 7*a* and 7*b* (with reference to FIG. 2) accomplish this narrow potential drop. Through the use of emissive electrodes, this potential drop can be produced more effectively over a narrow region, since the plasma sheath will not form effectively. We disclose that it is possible to achieve plume narrowing even with a single segmented electrode at near the cathode potential, provided that said electrode is placed somewhat to the cathode-side of the magnetic field maximum, although better performance can be achieved by employing also an electrode biased near the anode potential on the anode side of the maximum in the magnetic field. Some details of specific desirable electrode placement can be found in the literature (Raitses et al., "Plume Reduction in Segmented Electrode Thruster," Journal of Applied Physics 88, 1263, August 2000; Fisch et al., "Variable Operation of Hall Thruster with Multiple Segmented Electrodes", Journal of Applied Physics 89, 2040, February 2001), said details being covered also in U.S. Provisional Application Serial No. 60/197,280, filed Apr. 14, 2000, through which the present application seeks priority.

Note that the present application differs from Lysikov et al. (SU 1796777 A1, 1993). Lysikov et al. discloses an additional internal thermionic cathode, supplementary to the cathode compensator outside the acceleration region. The internal cathode is apparently placed where the magnetic field lines are approximately radial, which is approximately at the radial magnetic field maximum. The internal cathode is positioned on the discharge chamber apparently at the potential of the external cathode. Lysikov et al. evidently contemplates the main potential difference to appear between the anode and the internal thermionic cathode. However, the bulk of this potential drop will then occur where the magnetic field lines are not purely radial. Moreover, Lysikov et al. contemplates a thermionic electrode, rather than an emissive electrode. The thermionic electrode is a relatively small wire and the emission from it will be space-charge limited, resulting in a potential drop between the thermionic electrode and the plasma. Thus, the accelerating ions in the center of the thruster will experience considerable acceleration past the radial magnetic field maximum as well, including the radial acceleration that leads to the plume divergence. Because the thermionic cathode is relatively small, it is also the case that it does not intersect much of the fringing magnetic field, so that the full fringing magnetic field is not constrained to the same electric potential. Thus, considerable ion acceleration can take place in the fringing field where the direction of acceleration has significant radial components, further enlarging the plume.

In contrast to Lysikov et al., the present invention contemplates the use of emissive and non-emissive electrodes. These electrodes are contemplated to be considerably longer in the axial direction than the thermionic cathode suggested by Lisikov et al. The longer length means that if emissive they can emit electrons over a considerably larger region. The longer length also means that, if not emissive, they can still intersect a considerable number of fringing magnetic lines of force, thereby constraining the voltage drop in the fringing region.

Moreover, in contrast to Lysikov et al., a method is disclosed here such that the potential drop occurs where the magnetic field lines are radial, said method requiring a segmented electrode on the cathode side of the magnetic field maximum. Moreover, to narrow the region of the potential drop, the use and placement of pairs of segmented electrodes is disclosed here. The steeper the potential drop, the more narrow can be the plume divergence. Additionally, the steeper potential drop localizes the acceleration region precisely to the optimal axial location relative to the magnetic field maximum.

The example below serves to illustrate the invention by pointing out a specific and successful laboratory implementation of the design. This example is for illustrative purposes only, and is not meant to restrict in any way the use of the invention.

In one embodiment, suitable for a thruster operating in the range of 700 watts, the outer diameter of the boron nitride thruster channel is 90 mm, the voltage between anode and hollow cathode 8 is in the range of 300 volts. Xenon gas can be used as a propellant, said xenon flowing through thruster at a rate in the range of 1.7 to 2.5 milligrams per second. The anode-side and cathode-side segmented electrodes can have about 1 mm thickness of LaB6, plated in a rhenium mesh to provide a strong structure to the emissive layer. This mesh can be mounted on a molybdenum substrate ring of 3 mm thickness for each electrode. In said embodiment, the length of the anode-side electrode is 4 mm. The length of the cathode-side electrode is 10 mm. The anode-side segmented electrode has a triangular cross-section with 5 mm height into the channel. The two electrode sides, which are not attached to the wall, have a LaB6 layer. Thus, this electrode reduces the channel cross section area by 33% at the most constricted point. In an alternative embodiment, the same sizes can be used for segmented electrodes made of tantalum.

Figure 4:
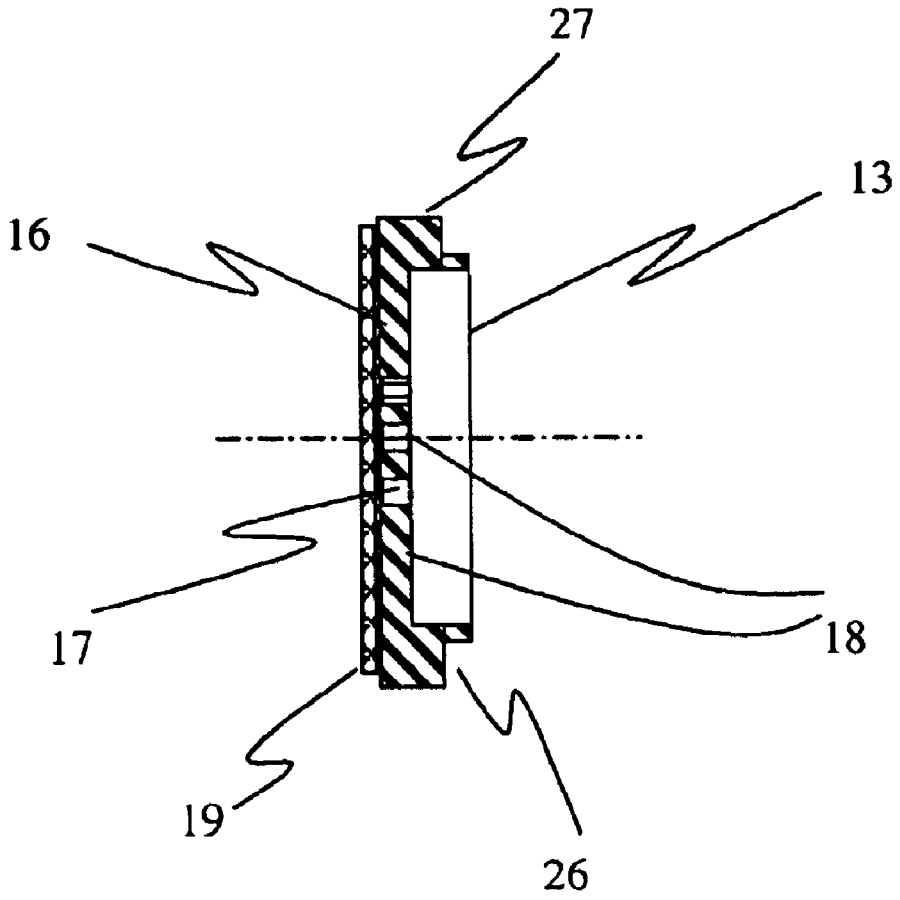
FIG. 4 shows an example of a non-emissive segmented electrode 7*d* (see for example FIG. 3). The electrode, which can be made from graphite, is placed on the inner channel wall 23 at the thruster exit. The electrode 7*d* is attached to the wall 23 by the side 13. To adjust the electrode location on the wall, the side 13 has a step 26, which has outer diameter equal to the inner diameter of the channel wall 23. The side 27 of the electrode faces the plasma. The outer side 16 has a hole 17 for a screw to fix the electrode onto the magnetic pole 12. This screw must be electrically isolated from the electrode and from the pole. For example, it can be made from a ceramic material. In addition, the threaded holes 18 allow electrical connection between the segmented electrode and the biased supply cable. The outer side 16, including all screw heads on this side, is covered by the protective dielectric layer 19 to avoid direct contact with plasma.

As an example, FIG. 4 shows a non-emissive, segmented electrode, made from graphite. In an embodiment suitable for employment in the above mentioned representative laboratory implementation, the outer diameter is 54 mm. When said electrode is placed on the inner wall of the ceramic channel near the thruster exhaust, a surface of 4 mm long is in contact with the plasma. The electrode is attached to the ceramic channel. A ceramic cap covers the left side of the electrode, so that said electrode does not contact the plasma. The holes at the center of the electrode are for fixing the electrode and for electric contact.

Figure 2:
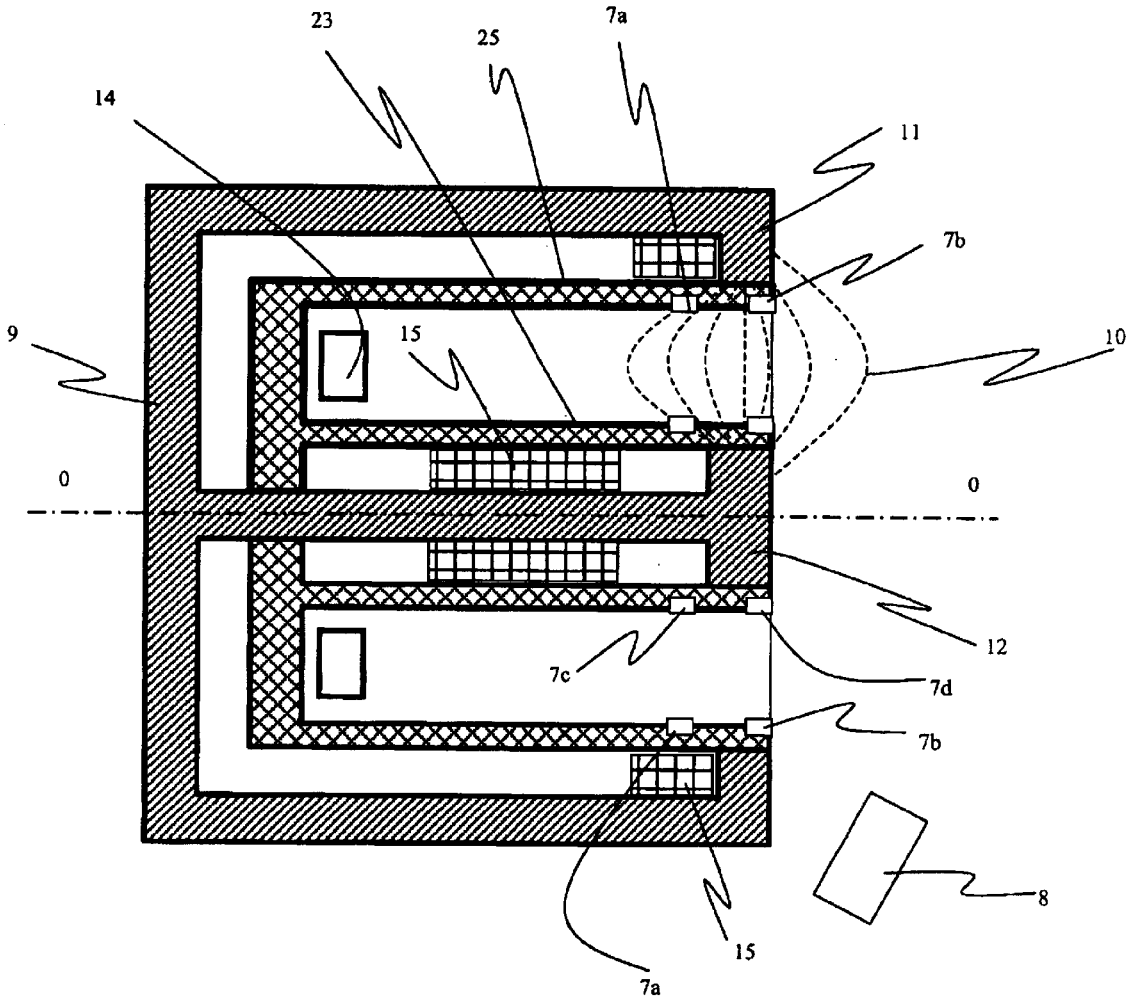
FIG. 2 is a schematic representation Hall thruster with segmented electrode rings 7*a* and 7*b* on the outer ceramic channel wall 25. Line 0—0 is an axis of symmetry. Segmented electrode 7*b* is near the thruster exit. Hollow cathode 8 emits electrons and neutralizes the flow of ions. An accelerating voltage drop is applied between anode 14 and hollow cathode 8, such that ions formed near the anode 14 are accelerated towards the thruster exit. The anode 14 can also be a gas distributor. Magnetic field lines 9 extend from magnetic pole pieces 11 on the outer ceramic channel wall 25 and intersect magnetic pole pieces 12 on the inner ceramic channel wall 23. Electromagnetic coils 15 generate the magnetic field, which is guided through magnetic circuit 9 to the pole pieces. (An additional optional matched set of segmented electrodes 7*c* and 7*d*, placed on the inner channel wall 23 supplements said segmented electrode set 7*a* and 7*b*, such that said segmented electrode 7*c* intersects the same magnetic line of force as does electrode 7*a* and is held at the potential of electrode 7*a*. Similarly, said segmented electrode 7*d* intersects the same magnetic line of force as does electrode 7*b* and is held at the potential of electrode 7*b*.)

As a further example, two segmented electrodes may be employed, one at the anode side of the thruster and one at the cathode side of the thruster (see FIG. 2). The use of two electrodes defines a very localized potential drop.

We disclose that low plume divergence operation is possible with just one segmented non emissive electrode, employed near the channel exit, on the cathode-side of the magnetic field maximum. For the case here considered as a representative example, the optimal placement of this non emissive electrode is centered two cm from the magnetic field maximum for thruster voltage in the range of 200–300 volts and xenon gas flow rates of 1.7 mg per second. In this case, the electrode is non emissive and is biased at the cathode potential. Full angle plume reductions of approximately 20 degrees are then obtained. However, the use of only one electrode may result in some decrease in overall efficiency. However, we disclose as a preferred embodiment that low plume divergence operation is possible without loss in efficiency if both an anode-side and a cathode-side electrode are employed. That anode-side segment tends to increase the efficiency if it is biased at the anode potential. We disclose further that the mere presence of an anode-side segmented electrode can increase the efficiency in some regimes of thruster operation even if said anode-side electrode is at floating potential. For the case considered, an anode side electrode biased at the anode potential with a ten mm spacing between anode-side and cathode-side segmented electrodes gives the highest efficiency, while retaining the decreased plume divergence.

As a preferred embodiment, we disclose that high efficiency persists even as the anode-side segmented electrode is biased at an intermediate potential. Thus, two-stage operation, similarly at high efficiency and low plume divergence, can be achieved. The use of these electrodes therefore extends considerably the parameter regimes for favorable operating characteristics of Hall plasma accelerators. Therefore, as a further preferred embodiment, we disclose that through simple switching of electrode energizing, one may achieve a variable mode of operation. For example, by maintaining the anode-side electrode at or near the anode potential, but varying the cathode-side electrode potential, variable specific impulse can be achieved within the same thruster channel and with decreased plume divergence.

As a preferred embodiment, we disclose the use of emissive electrodes rather than non emissive electrodes, to reduce further the plume divergence. We further disclose (see FIG. 3) placement of segmented electrodes on either the inner or outer chamber wall, such that adjacent electrodes are placed on opposite walls, in so-called "staggered" placement. Since the magnetic field lines form equipotential surfaces at approximately constant axial location, it makes little difference in voltage profile along which wall the segmented electrode is placed. This is particularly so when the electrode is emissive. The staggered placement of electrodes therefore produces essentially the same advantageous voltage profile. However, because the electrodes are place physically far apart, the staggered arrangement substantially reduces the likelihood of arcing between the electrodes during start-up operation and the likelihood of other deleterious electrical effects associated with closely placed electrodes.

Figure 3:
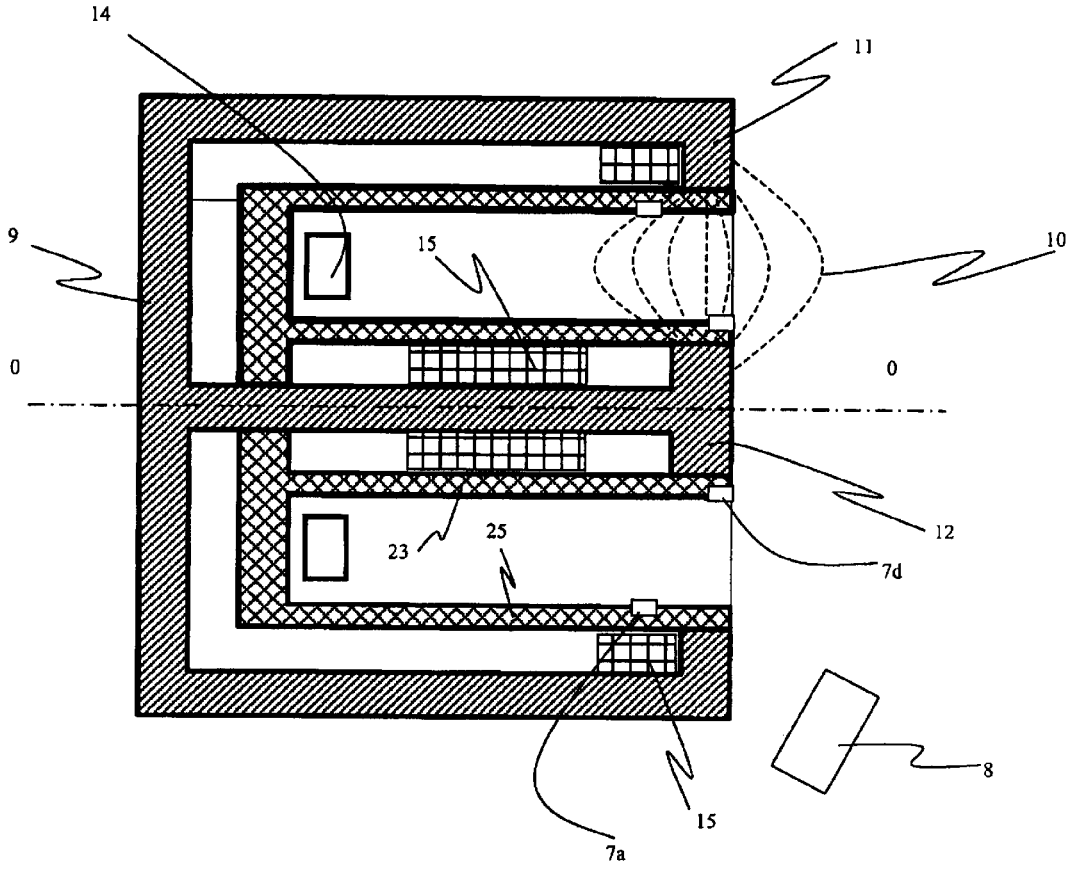
FIG. 3 is a schematic representation Hall thruster with segmented electrode ring 7*a* on the outer ceramic channel wall 25 and segmented electrode ring 7*d*, placed on the inner channel wall 23, thereby minimizing the possibility of electrical breakdown.

As a further preferred embodiment, we disclose advantages to employing inner and outer segmented electrodes as in FIG. 3, where the anode-side electrode is emissive and placed on the outer channel wall, whereas the cathode-side electrode is non emissive and placed on the inner channel wall. This configuration places the electrodes far from each other physically in order to avoid shorting and arcing. Moreover, the emissive electrode can provide electrons for the ionization region, allowing for the employment of a somewhat larger magnetic field. The cathode-side electrode is non-emissive, for which better sputter-resistant materials can be found. Also, such a configuration minimizes the deposition of the sputtered material from the electrodes on the channel wall, which may lead to electrical breakdown. The cathode-side electrode can be flat with the channel wall or placed in a groove to protect it from sputtering. Small circular groves can be on the opposite inner wall to avoid shorting between the low-voltage electrode and the high-voltage electrode. In addition, the wall opposite to each electrode can be made from ceramic material adsorbing the sputtering metal, thereby to avoid shorting. We further disclose that greater ionization may be achieved in some thruster regimes when the anode-side segmented electrode protrudes somewhat into the thruster channel, thereby constricting the plasma flow.

In yet another variation, the cathode-side electrode can be made emissive in order to reduce the potential drop near the fringing magnetic fields, thereby providing acceleration more axially directed. In yet another variation, the anode-side electrode can be made non-emissive in order to employ material more sputter-resistant, particularly in the case that the electrodes protrude significantly into the thruster channel.

As a further preferred embodiment, we disclose that placing said electrodes such that the annular segmented electrode rings of conducting material are positioned somewhat on the cathode-side of the magnetic field maximum, where the magnetic lines of force are somewhat concave, will produce a focusing effect on the accelerated ions. In this case, the segmented electrode pairs, such as 7*a* and 7*b* of FIG. 2, are employed also to define an abrupt potential drop.

The use of any of these embodiments and variations may be recommended depending on the anticipated parameters of the thruster regime, such as temperature, power, specific impulse, and propellant, as well as the anticipated mission requirements such as longevity, efficiency, and ease of satellite integration.

What we claim as our invention is:

1. A Hall thruster with closed electron drift, with a substantially axial electric field applied across a coaxial channel, with substantially radial magnetic fields applied across said channel, such that ions are accelerated and can flow axially across said magnetic field, but such that electrons drift substantially in the azimuthal direction, comprising of:

an annular channel, said channel formed between an outer wall that forms an outer cylindrical structure and an inner wall that forms an inner cylindrical structure, with said inner and outer walls made of an insulator material; and a distributor of propellant gas, such that said gas is ionized in channel and then said ions are accelerated by said electric field; and an anode, near the point of entry of the propellant gas into the channel; and a cathode-neutralizer, located outside said channel, that both neutralizes said ion flow and establishes total accelerating voltage of said ions; and a magnetic circuit that produces said substantially radial magnetic field; and electrode segments of conducting material, placed along said channel, separated electrically by spacers of dielectric material; and an electric circuit holding said electrode segments at specific potentials, so as to control the axial potential within the thruster channel.

2. An apparatus according to claim 1 such that the segmented electrodes along said coaxial channel comprise rings of conducting material on the outer channel radii only.

3. An apparatus according to claim 1 such that the segmented electrodes along said coaxial channel comprise rings of conducting material on the inner channel radii only.

4. An apparatus according to claim 1 such that said rings of conducting material are on the inner and outer channel radii, with said rings on inner and outer radii arranged in pairs, with each said pair intersecting substantially the same line of magnetic force.

5. An apparatus according to claim 1 such that said rings of conducting material are made of emissive material.

6. An apparatus according to claim 1 such that said rings of conducting material are made of substantially non-emissive material.

7. An apparatus according to claim 1 such that said rings of conducting material are on the inner and outer channel radii, with said rings on inner and outer radii arranged in a staggered design, such that electrodes placed on either said inner channel wall or said outer channel wall are followed by electrodes placed on the opposite wall, so as establish an axial potential with maximum physical distance between material electrode segments.

8. An apparatus according to claim 7 such that one segmented electrode ring of conducting material is placed on the anode-side of the magnetic field maximum; and one segmented electrode ring is placed between said anode-side segmented electrode and the thruster exit; and such that said anode-side segmented electrode is biased negative with respect to the anode.

9. An apparatus according to claim 7 such that said rings of conducting material are made of emissive material.

10. An apparatus according to claim 1 such that one set of electrodes establishes a localized potential drop in the acceleration region; and such that one segmented electrode ring of conducting emissive material is placed on the anode-side of the magnetic field maximum; and such that said anode-side segmented electrode is biased negative with respect to the anode; and such that said anode-side emissive electrode emits electrons sufficient for ionization of the propellant gas.

11. An apparatus according to claim 1 such that said rings of conducting material are made of emissive material, and such that one set of electrodes establishes a localized potential drop in the acceleration region; and such that one segmented electrode ring of conducting emissive material is placed on the cathode-side of the magnetic field maximum; and such that said cathode-side emissive electrode emits electrons sufficient for neutralization of the ion stream.

12. An apparatus according to claim 1 such that said segmented electrode annular rings of conducting material are positioned in the region along said thruster channel so as to establish a large axial potential drop where the applied radial magnetic field is substantially in the radial direction across the full channel, so as to optimally limit the ion plume divergence.

13. An apparatus according to claim 1 such that said segmented electrode annular rings of conducting material are positioned in the region along said thruster channel so as to establish a large axial potential drop where the applied radial magnetic field is substantially in the radial direction, but also concave outwards towards the thruster exit, so as to produce a focusing effect on the accelerated ions.

14. An apparatus according to claim 1 such that said electrodes are annular rings of conducting material positioned in the region along said thruster channel so as to establish a large axial potential drop where the applied radial magnetic field is substantially purely in the radial direction across the full channel; and such that the segmented electrode ring closest to the anode juts out into said thruster channel, thereby to constrict the plasma flow within the channel, so as to provide greater ionization.

15. An apparatus according to claim 5 such that said emissive electrodes are made of high-temperature low-sputtering low work-function material, such as LaB6, dispenser tungsten, or barium oxide.

16. An apparatus according to claim 6 such that said non-emissive electrodes are made of low-sputtering material, such as graphite or graphite modifications such as carbon-carbon fibers, tungsten, or molybdenum.

17. An apparatus according to claim 1 such that said electric circuit includes switching circuitry capable of providing variable operation.

18. An apparatus according to claim 1 such that said propellant gas is xenon and such that said total accelerating voltage potential is approximately 300 volts.

19. A Hall thruster with closed electron drift, with a substantially axial electric field applied across a coaxial channel, with substantially radial magnetic fields applied across said channel, such that ions are accelerated and can flow axially across said magnetic field, but such that electrons drift substantially in the azimuthal direction, comprising of:

an annular channel, said channel formed between an outer wall that forms an outer cylindrical structure and an inner wall that forms an inner cylindrical structure, with said inner and outer walls made of an insulator material; and a distributor of propellant gas, such that said gas is ionized in channel and then said ions are accelerated by said electric field; and an anode, near the point of entry of the propellant gas into the channel; and a magnetic circuit that produces said substantially radial magnetic field; and a pair of electrode segments of emissive conducting material, placed along said channel; and such that said rings of electrodes establish a localized potential drop in the acceleration region; and such that said cathode-side emissive electrode emits electrons sufficient for neutralization of the accelerated ions, thereby eliminating the need for a separate cathode-neutralizer; and an electric circuit holding said electrode segments at specific potentials, so as to control the axial potential within the thruster channel.

20. An apparatus according to claim 19, such that a potential drop is established between the anode-side emissive electrode and the anode; and such that said anode-side emissive electrode emits electrons sufficient for ionization of the propellant gas.

* * * * *